US005268247A

United States Patent [19]

Hayashi

[11] Patent Number: 5,268,247

[45] Date of Patent: Dec. 7, 1993

[54] ELECTROPHOTOGRAPHIC COPYING MACHINE AND ELECTROPHOTOGRAPHIC MEMBER THEREFOR AND METHOD OF FORMING AN ELECTROPHOTOGRAPHIC MEMBER

[75] Inventor: Shigenori Hayashi, Kanagawa, Japan

[73] Assignee: Semiconductor Energy Laboratory Co., Ltd., Kanagawa, Japan

[21] Appl. No.: 764,490

[22] Filed: Sep. 24, 1991

[30] Foreign Application Priority Data

Sep. 25, 1990 [JP] Japan ..... 2-25672

[51] Int. Cl.[5] ..... G03G 5/14

[52] U.S. Cl. ..... 430/67; 430/58; 355/271

[58] Field of Search ..... 430/66, 67, 58, 59; 355/271

[56] References Cited

U.S. PATENT DOCUMENTS 4,770,966 9/1988 Kazama et al. ..... 430/66

4,939,056 7/1990 Hotomi et al. ..... 430/55

5,059,502 10/1991 Kojima et al. ..... 430/66

*Primary Examiner*—John Goodrow

*Attorney, Agent, or Firm*—Sixbey, Friedman, Leedom & Ferguson

[57] ABSTRACT

A printing drum (An electrophotographic member) for electrophotographic copying machines comprises a substrate, a photosensitive film formed on the substrate and a protective film formed on the photosensitive film and mainly comprising carbon at no lower than 50 atom % and including hydrogen at 10 to 40 atom % and nitrogen at 1 to 10 atom %. The protective film may further include fluorine at 0 to 1 atom %. The transparency of the protective film is controlled by adjusting the concentration of hydrogen. The resistivity of the protective film is controlled by adjusting the concentration of nitrogen. By this configuration, requirements for the protective film on the hardness, the transparency and the resistivity of the protective film are satisfied at the same time.

17 Claims, 7 Drawing Sheets

ELECTROPHOTOGRAPHIC COPYING MACHINE AND ELECTROPHOTOGRAPHIC MEMBER THEREFOR AND METHOD OF FORMING AN ELECTROPHOTOGRAPHIC MEMBER

BACKGROUND OF THE INVENTION

1. Field of the Invention

The present invention relates in general to an electrophotographic copying machine. More particularly, it relates to an electrophotographic member for electrophotographic copying machines and a method of forming an electrophotographic member for electrophotographic copying machines.

2. Description of the Prior Art

An electrophotographic copying machine uses photoconductive effects to form the image. An image of the document to be duplicated is reproduced on a photosensitive surface in the form of toner patterns by virtue of electrostatic forces. In the CPC mode, the toner pattern is directly formed on a photosensitive sheet, which is used as a copy. In the PPC mode, the toner pattern is transferred from a photosensitive surface to a usual paper. The present invention relates mainly to the PPC mode. Xerography, also called Carson process, is a representative process of the PPC mode. The process comprises charging, exposure, development, transfer, fusing and cleaning. The process is implemented by a photosensitive printing member (drum), an electric charging device, an exposing device, a transferring device, a fusing device, an electricity remover and a cleaner.

The life time of such an electrophotographic copying machine is primarily determined by the life time of the photosensitive member (drum). Namely, the reliability of an electrophotographic copying machine is significantly improved by improving that of the photosensitive member (drum).

Photosensitive materials coated on the drums include organic resins, amorphous silicons and selenium alloys. The surfaces of such photosensitive coatings tend to experience abrasion caused by frictional forces at the contact with a transfer sheet, development roller and a cleaning blade or brush. The wearing of the coating is further accelerated by toner or a lubricant contained in toner. For this reason, some attempts have been tried to coat the surface with protective films made of organic resin, $Al_2O_3$, $Si_3N_4$ and other inorganic materials.

The resistivity of such protective films has to be between $10^8$ and $10^{12}$ Ωcm. If the resistivity is less than $10^8$ Ωcm, diffusion of electric latent images, i.e. lateral leakage of charge takes place resulting in degraded images out of focus. If the resistivity is higher than $10^{12}$ Ωcm, electric charge is always accumulated in the film and hindered normal dissipation of electric charge and clear formation of images during repetition of copying. Namely, the quality of the copied images can not be maintained for a long time. The transmissivity of the protective film, on the other hand, has to be no lower than at least 50% in a range between 400 nm and 800 nm, and not lower than 80% in a range between 500 nm and 800 nm, taking into account the application to color copy.

The applicant filed a Japanese patent application No. sho 56-146936 on May 17, 1981 titled "Complex with a carbon film and a Method of Manufacturing the Same" to propose protective films which satisfy abovementioned requirements such as abrasion-proof, necessary optical and electrical characteristics. Films mainly composed of carbon can be easily formed to be substantially transparent to visible light with Vickers hardness higher than 2000 Kg/mm$^2$. The resistivity can be controlled between $10^8$ and $10^{13}$ Ωcm by adjusting the deposition condition of the carbon film. This is convenient for application to photosensitive films for copying machines.

The carbon films have good compatibility and adhesivity with organic photoconductive materials (OPC). These desirable properties are considered because there may be formed polymerization at the interface between the carbon film and the OPC film. It has been confirmed by the inventor, however, that there has to be a trade-off among several important characteristics of the carbon film. Namely, whereas Vickers hardness higher than 2000 kg/mm$^2$ is easily obtained, the absorption coefficient eventually rises, for example, to 0.6 $\mu m^{-1}$, which corresponds to a transmissivity of 74% in the case of 5000 Å thickness, and the resistivity is lowered to $10^6$ to $10^7$ Ωcm. This trade-off results in low sensitivity due to weak light passing through the protective film and disturbance of image formation due to the low resistivity. Contrary to this, low absorption coefficient as low as 0.2 $\mu m^{-1}$ can be obtained at the expense of Vickers hardness as low as 500 kg/mm$^2$ and resistivity as high as $10^{14}$ to $10^{15}$ Ωcm.

BRIEF SUMMARY OF THE INVENTION

As explained above, it is easy to satisfy one of these requirements on the characteristics respectively. Namely, when carbon films are deposited by plasma CVD, any one of the hardness, the transmissivity and the resistivity can be controlled by suitably selecting the deposition condition. The important factors of the deposition condition are the pressure of a reactive gas and the negative bias voltage applied to a substrate, whereas there are of course less influential many other factors such as the input power, the configuration of the system, the location of the substrate, the substrate temperature, the reactive gas, the mixture rate of constituent gases and so forth. The negative bias voltage is, in general, a function of the input power for main electric discharge when parallel plate type electrodes are used in the CVD system. The input power is supplied to the electrodes by one or two electric energy source for main discharge. The bias voltage, however, can be controlled with little influence of the input voltage when plasma CVD is carried out in a positive column type system provided with a middle frequency electric energy source (1 to 1000 kHz) for bias application in addition to the energy source for main discharge. For this reason, the positive column type is desired rather than the parallel plate type because of a large degree of freedom to independently control the bias voltage level. The input power by the energy source for main discharge influences the deposition speed.

The relationship among the respective characteristics will be described hereinbelow with reference to FIGS. 1(A), 1(B) and 1(C). In this description, the negative bias voltage is called high when the absolute value thereof is large. As seen from figures, the hardness (FIG. 1(A)) and the absorption coefficient (FIG. 1(B)) increase and the resistivity (FIG. 1(C)) decreases as the negative bias voltage rises and/or as the reaction pressure decreases. The hardness is determined by the ratio of $sp^3$ bonds to $sp^2$ bonds occurring in the carbon film.

The hardness increases as the $sp^3$ bonds increase. The ratio of $sp^3$ is believed to increase when the carbon film is exposed during deposition to stronger bombardment of positive ions of hydrogen, carbon, hydrocarbon and the like. This is because the $sp^2$ bonds are etched by these positive ions. The bombardment is enhanced by increasing the negative bias voltage and decreasing the reaction pressure.

The ion bombardment, however, is effected to increase dangling bonds as well as the $sp^3$ bond ratio in the carbon film. Dangling bonds are accompanied by local electrons, which are responsible for hopping conduction between dangling bonds. The resistivity of the carbon film decreases as the density of the dangling bonds and therefore hopping conduction increases. In addition, the local electrons accompanying the dangling bonds absorbs light incident on the film resulting in reduction of transparency of the film, i.e. increase of absorption coefficient. FIG. 4 shows areas (dashed) of the negative bias voltage and the reaction pressure satisfying the requirements with respect to each of the resistivity, the absorption coefficient and the hardness. The areas are between $10^8$ and $10^{12}$ Ωcm, no higher than 0.2 $\mu m^{-1}$ and no lower than 1200 kg/mm$^2$ respectively for resistivity, absorption coefficient and Vickers hardness. As shown in the figure, there is no area satisfying all the requirements of the resistivity, the absorption coefficient and the hardness.

The inventor has discovered that it is possible to suppress formation of dangling bonds and reduce the absorption without decreasing the hardness by suitably introducing hydrogen together with the carbon reactive gas for deposition. The reactive gas is diluted by hydrogen during gas introduction. The proportion of the carbon reactive gas in the diluted reactive gas is no higher than 50%, desirably no higher than 20%. FIGS. 2(A), 2(B) and 2(C) are graphical diagrams respectively showing the hardness, the absorption coefficient and the resistivity with reference to the negative bias voltage and the reaction pressure in this case. The hydrogen terminates dangling bonds occurring in the film and decreases the absorption coefficient to 0.2 $\mu m^{-1}$ or lower (FIG. 2(B)) without decreasing the hardness. The carbon reactive gas includes saturated hydrocarbons such as $CH_4$, $C_2H_6$, $C_3H_8$ and unsaturated hydrocarbons such as $C_2H_4$, $C_2H_2$, $C_6H_6$. Some hydrogen of the hydrocarbons may be replaced by halogen such as fluorine.

On the other hand, electrical defects are also eliminated by the termination of dangling bonds so that the probability of hopping of local electrons decreases resulting in a higher resistivity, e.g. no lower than $10^{15}$ Ωcm (FIG. 2(C)). The high resistivity is too high to apply for electrophotographic copying machines. FIG. 5 shows areas (dashed) of the negative bias voltage and the reaction pressure satisfying the requirements on the protective film with respect to each of the resistivity, the absorption coefficient and the hardness. As shown in the figure, there is no area satisfying all the requirements of the resistivity, the absorption coefficient and the hardness because of the high resistivity. The inventor succeeded in controlling the resistivity of the carbon film, maintaining the hardness and the absorption coefficient within desired ranges required. For this purpose, $NF_3$ is mixed with the reactive gas at a ratio of the reactive gas: $NF_3$=1: 0.2 to 4.0. The resistivity is controlled to be an appropriate value between $10^8$ and $10^{12}$ Ωcm by adjusting the ratio. The resistivity is controlled by holes generated by nitrogen atoms rather than dangling bonds. Since the energy states generated by nitrogen atoms are deep, the conductivity is not so high as silicon semiconductors. The concentration of nitrogen atoms in the carbon film was measured to be 1 to 10 atom % by Auger analysis. $NH_3$ may be used in place of $NF_3$ as the nitrogen source. However, $NF_3$ is desirable because dissociation in plasma easily takes place as compared with the case of $NH_3$. Furthermore, fluorine atoms of $NF_3$ tend to combine with hydrogen to form HF so that extraction of hydrogen is accelerated resulting in speed up of deposition. The absorption coefficient, the resistivity and the hardness are satisfied at the same time as shown in FIG. 6.

Another important factor for abrasion-proof is the thickness of the carbon protective film. The resistance to abrasive force is improved by increasing the thickness. In accordance with the present invention, the thickness can be increased because the absorption coefficient is decreased by dilution of the reactive gas with hydrogen. It is assumed from the desirability of increased thickness for abrasion-proof structure that the abrasion-proof is influenced by the hardness of the underlying surface. In the case of an underlying surface made of an organic photoconductive material having a Vickers hardness of 4 to 20 kg/mm$^2$, the underlying surface is desirably coated with a buffer film of 0.3 to 0.8 μm thickness having a vickers hardness of 100 to 400 kg/mm$^2$. If the buffer film comprises carbon or a carbon compound, good adhesivity with the organic underlying film is expected. The buffer film may be a multi-layered film comprising a plurality of suitable layers. In the case of an underlying surface made of a hard material such as amorphous silicon, no buffer film is needed.

It is therefore an object of the present invention to provide an electrophotographic copying machine having a high reliability.

It is another object of the present invention to provide an abrasion-proof electrophotographic member (printing member) for electrophotographic copying machines having a high reliability and a method of forming the same.

Additional objects, advantages and novel features of the present invention will be set forth in the description which follows, and in part will become apparent to those skilled in the art upon examination of the following or may be learned by practice of the present invention. The object and advantages of the invention may be realized and attained by means of the instrumentalities and combinations particularly pointed out in the appended claims.

To achieve the foregoing and other object, and in accordance with the present invention, as embodied and broadly described herein, an electrophotographic member (printing member) for electrophotographic copying machines comprises a substrate, a photosensitive film formed on the substrate and a protective film provided on the photosensitive film and mainly comprising carbon at no lower than 50 atom % and containing hydrogen at 10 to 40 atom %, and nitrogen at 1 to 10 atom %. The protective film may further contain fluorine at 0 to 1 atom %. An electrophotographic copying machine in accordance with the present invention comprises means for charging an electrophotographic member, means for applying a light image to the charged electrophotographic member to form a latent charge image on the electrophotographic member, means for applying toner to the latent charge image to form a toner image, and means for transferring the toner image to a copy medium, wherein said electrophotographic member comprises a substrate, a photosensitive film formed on said substrate, and a protective film formed on said photosensitive film and comprising carbon at no lower than 50 atom %, hydrogen at 10 to 40 atom %, and nitrogen at 1 to 10 atom %.

BRIEF DESCRIPTION OF THE DRAWINGS

The accompanying drawings, which are incorporated in and form a part of the invention and, together with the description, serve to explain the principles of the invention.

DETAILED DESCRIPTION OF THE PREFERRED EMBODIMENTS

Figure 1A:
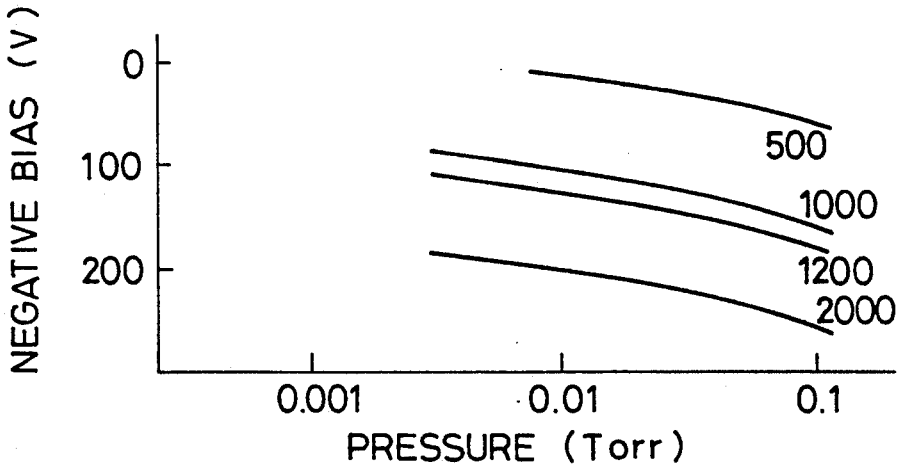
FIGS. 1(A), 1(B) and 1(C) are graphical diagrams respectively showing the Vickers hardness, the absorption coefficient and the resistivity of carbon protective films versus the negative bias voltage and the reaction pressure in conventional cases.
Figure 1B:
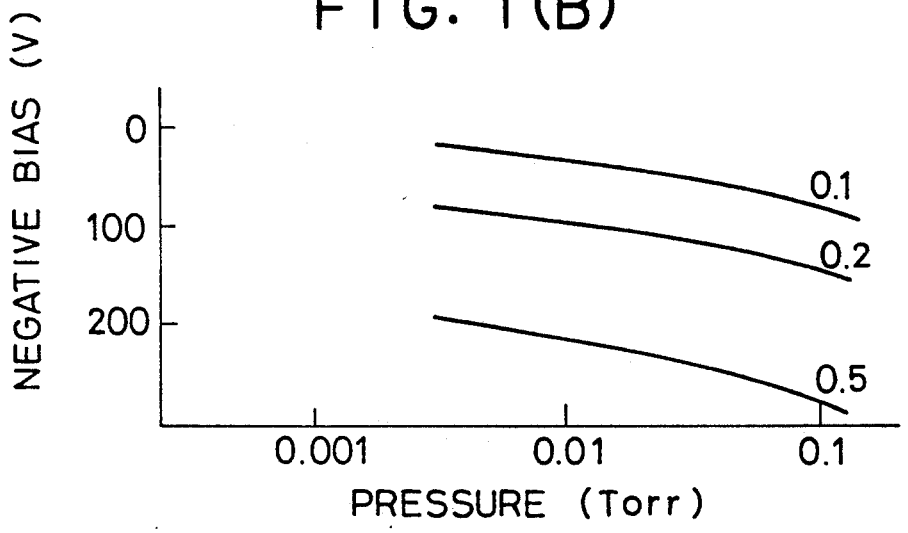
Figure 1C:
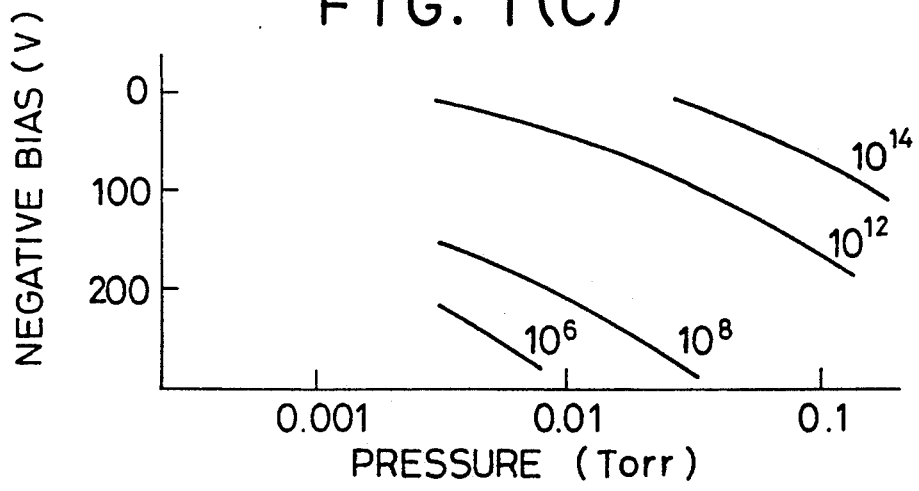
Figure 2:
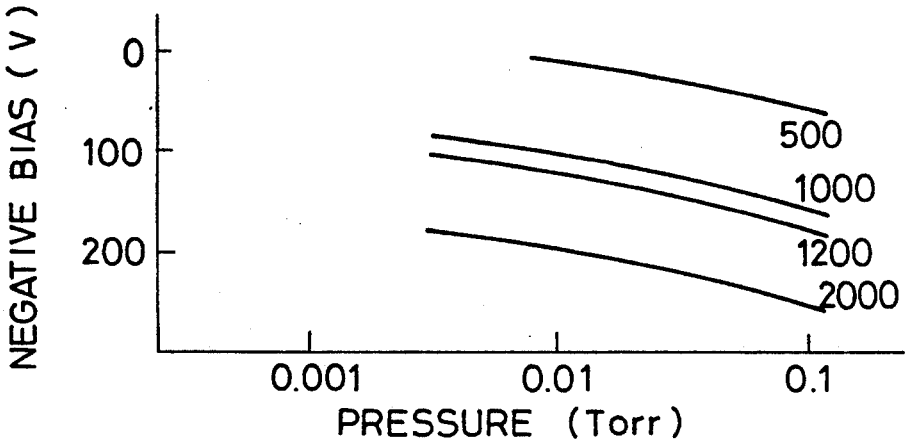
FIGS. 2(A), 2(B) and 2(C) are graphical diagrams respectively showing the Vickers hardness, the absorption coefficient and the resistivity of carbon protective films versus the negative bias voltage and the reaction pressure when hydrogen is introduced into the protective films.
Figure 2:
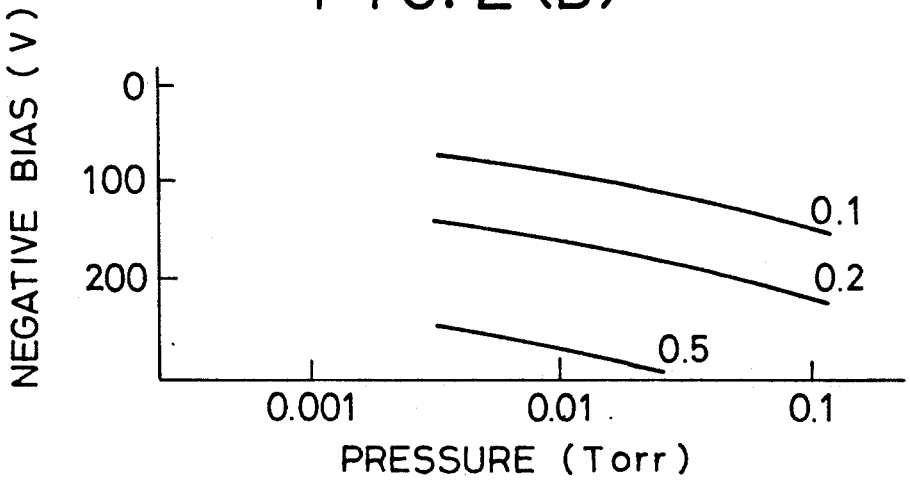
Figure 2:
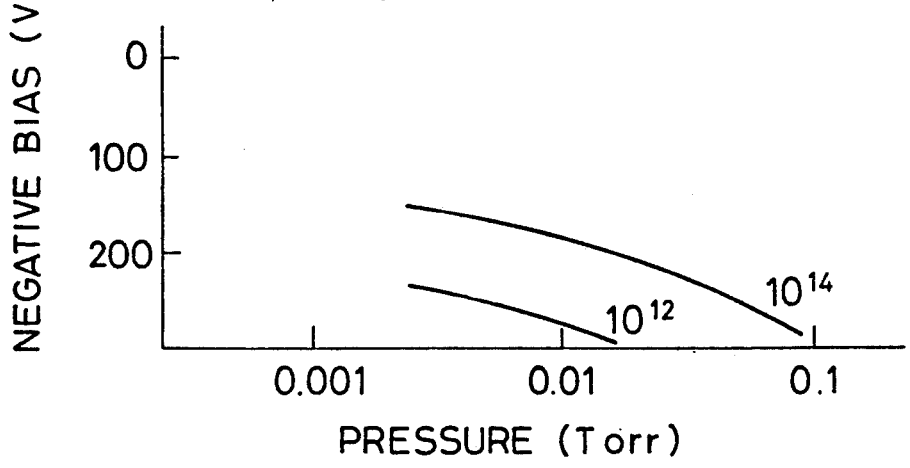
Figure 3A:
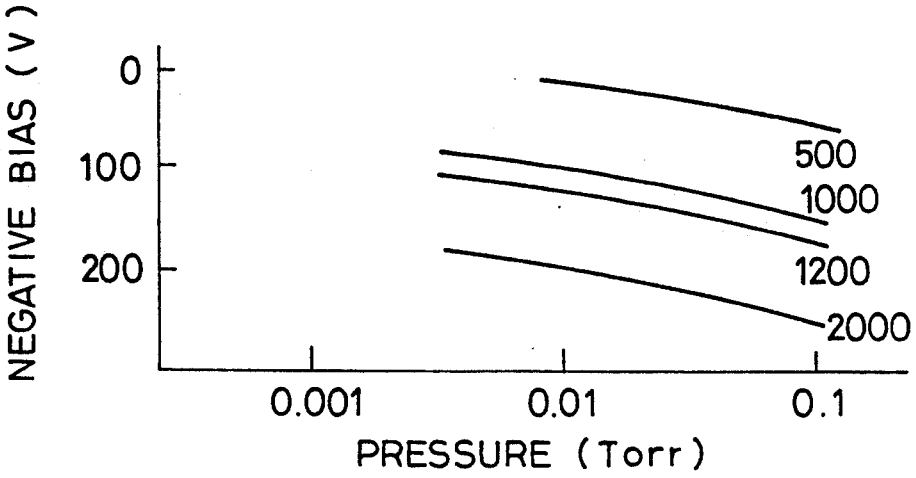
FIGS. 3(A), 3(B) and 3(C) are graphical diagrams respectively showing the Vickers hardness, the absorption coefficient and the resistivity of carbon protective films versus the negative bias voltage and the reaction pressure when hydrogen and nitrogen are introduced into the protective films.
Figure 3B:
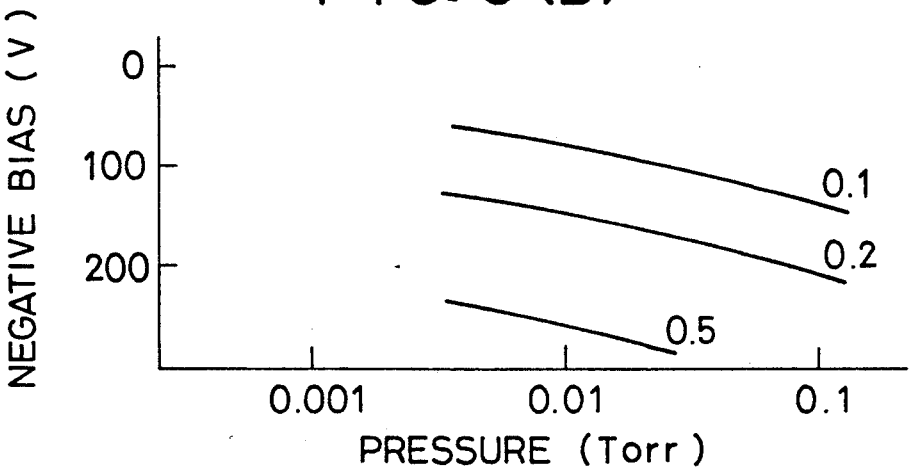
Figure 3C:
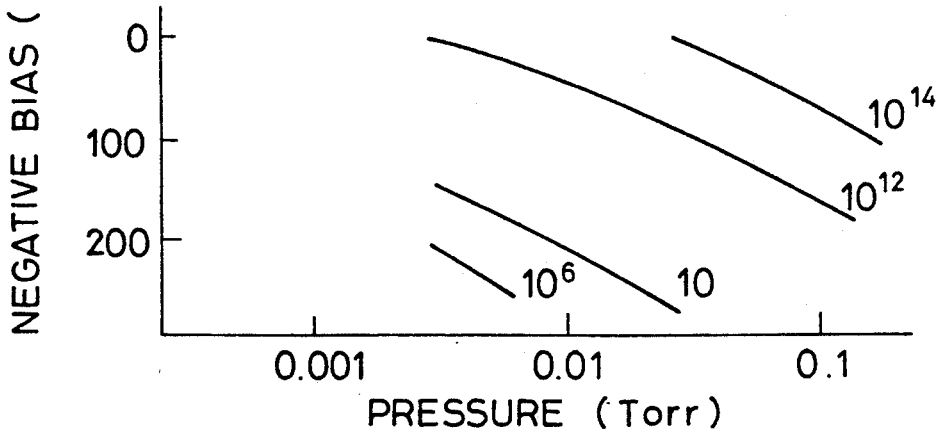
Figure 4:
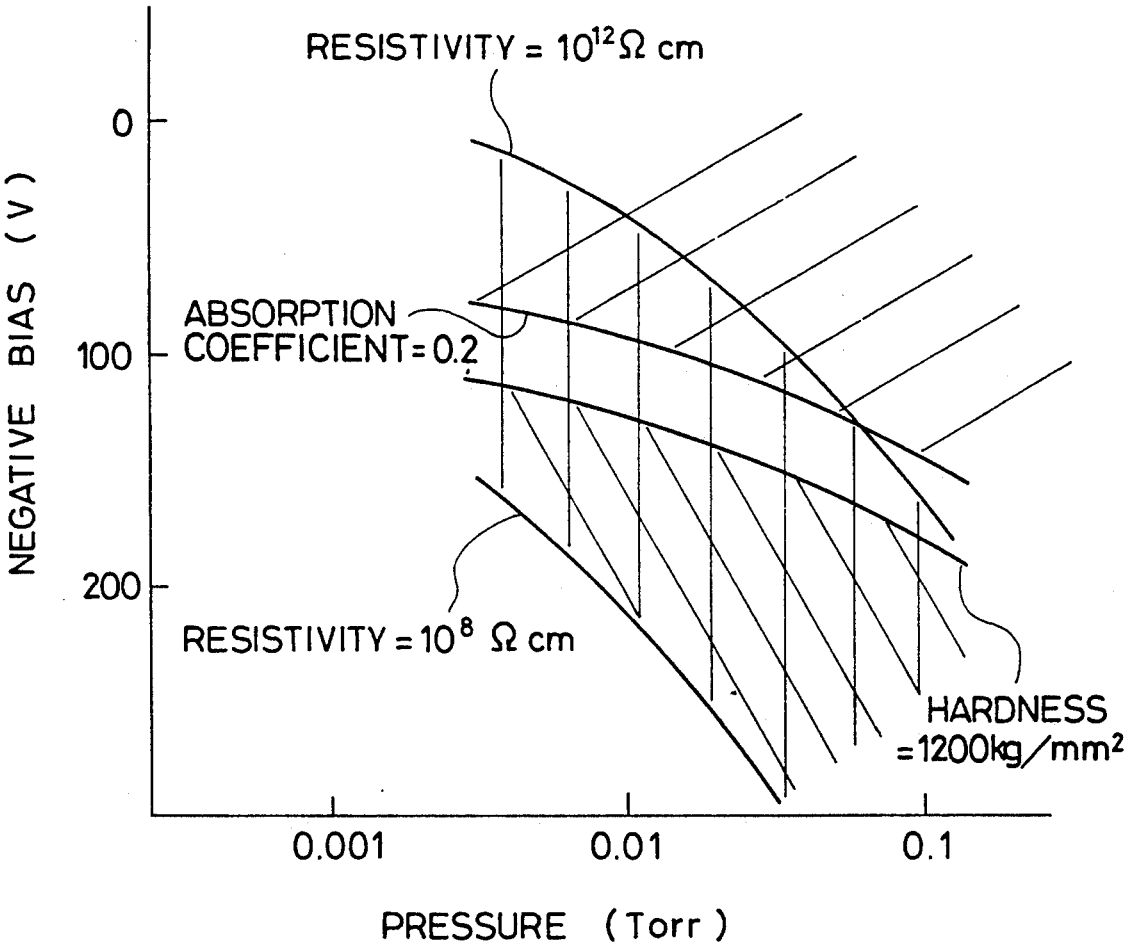
FIG. 4 is a graphical diagram showing the ranges required of carbon protective film for electrophotographic copying machines with respect to the resistivity, the absorption coefficient and the Vickers hardness in conventional cases.
Figure 5:
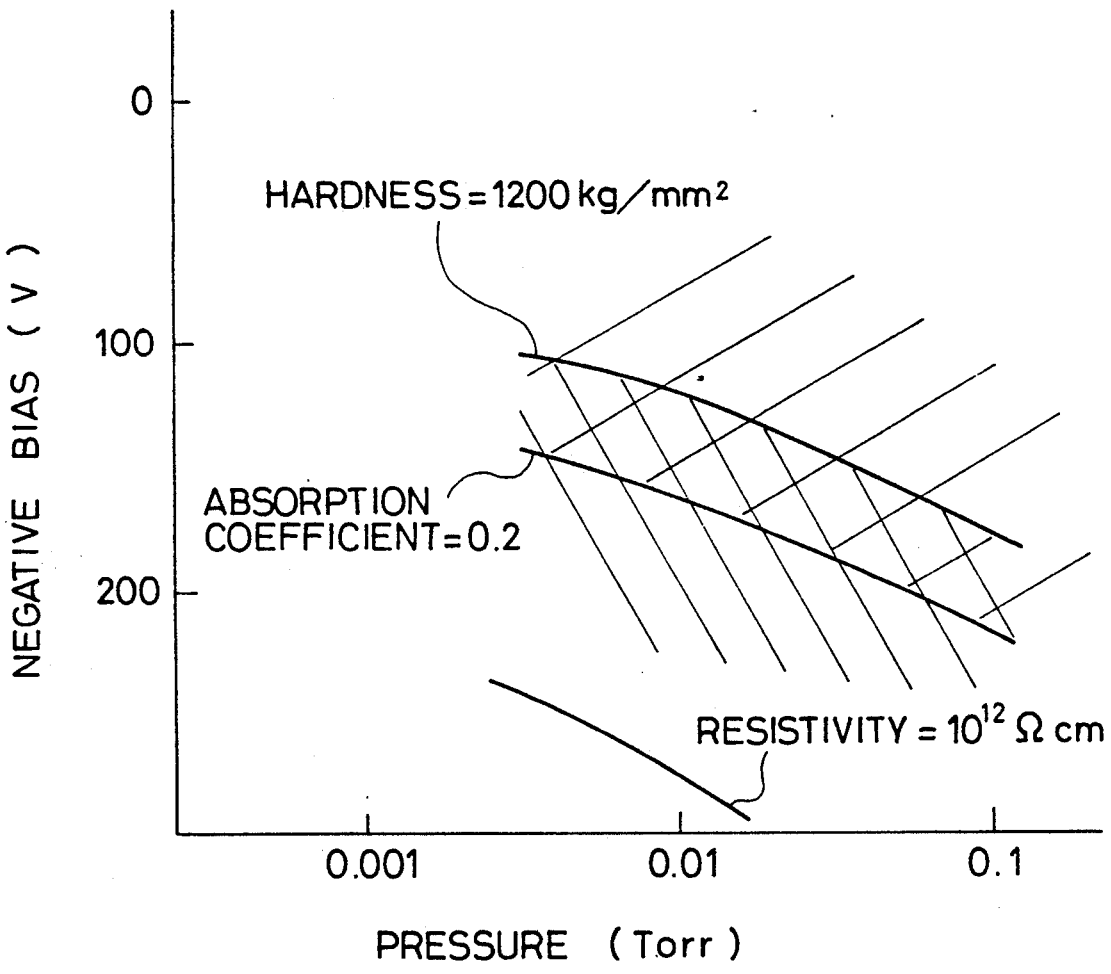
FIG. 5 is a graphical diagram showing the ranges required of carbon protective film for electrophotographic copying machines with respect to the resistivity, the absorption coefficient and the Vickers hardness when hydrogen is introduced into the protective films.
Figure 6:
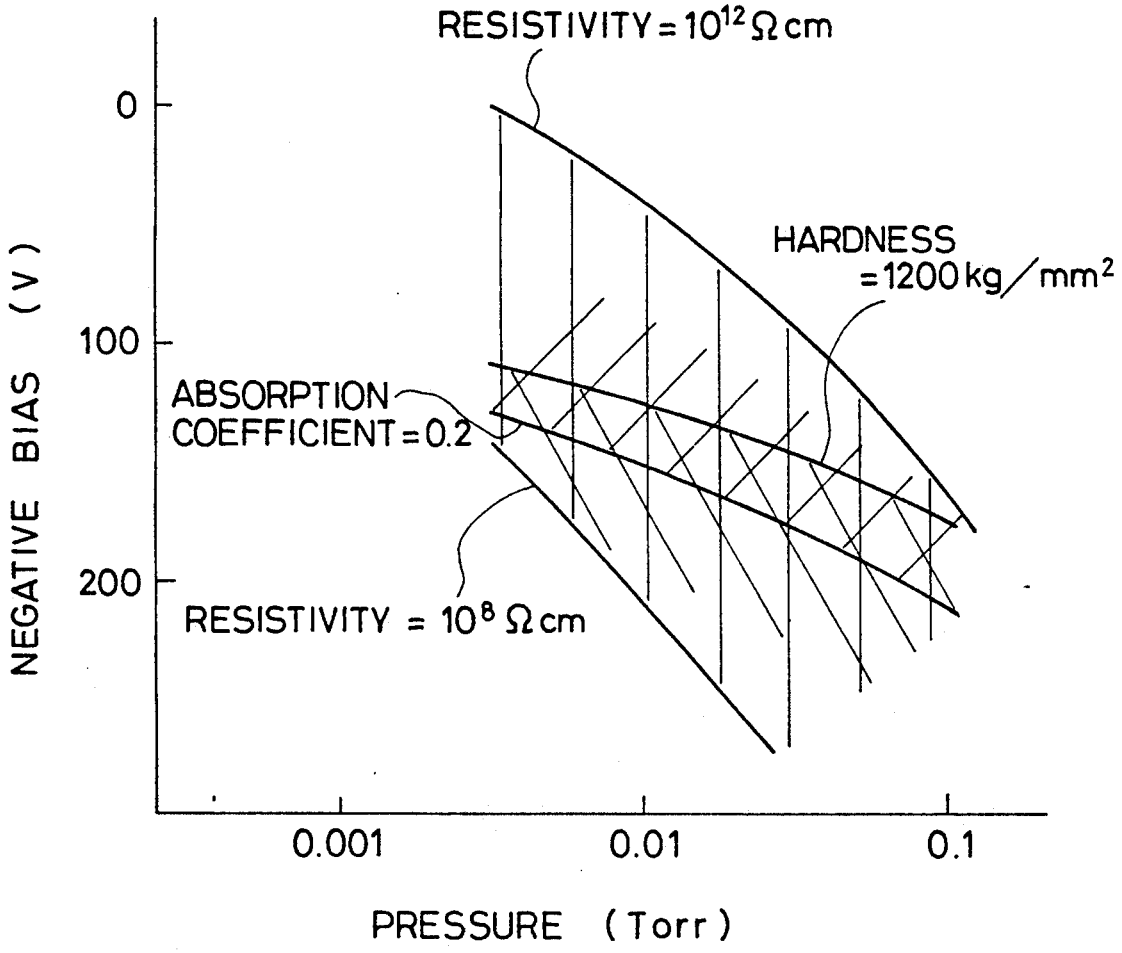
FIG. 6 is a graphical diagram showing the ranges required of carbon protective film for electrophotographic copying machines with respect to the resistivity, the absorption coefficient and the Vickers hardness when hydrogen and nitrogen are introduced into the protective films.
Figure 7:
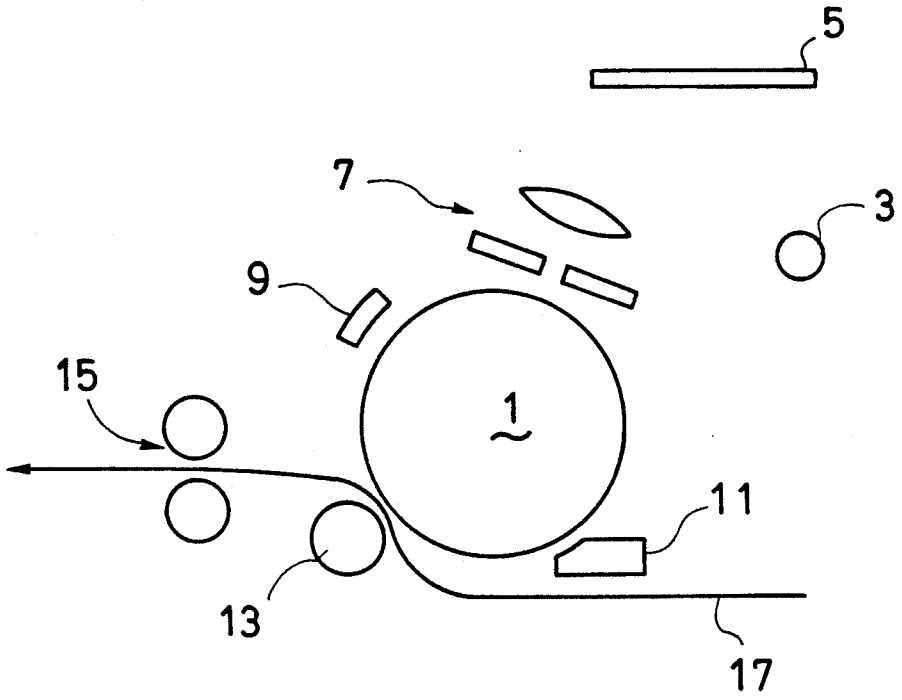
FIG. 7 is a schematic view showing a general arrangement of an electrophotographic copying machine.

Referring now to FIG. 7, an electrophotographic copying machine in accordance with the present invention is illustrated in a schematic view. The machine generally comprises a photosensitive printing drum (an electrophotographic member) 1 rotatably supported along its axis, a lamp 3 for exposing an original 5 to light, an optical system 7 for focussing an optical image of the original onto the drum 1, a charging means 9 for uniformly giving electric charge to the surface of the drum 1, a development means 11 for forming a toner image on the drum 1, a transfer means 13 for transferring the toner image from the surface of the drum 1 to a copy medium (sheet) which is conveyed along curve 17 and a fusing means 15 for fusing the toner to the copy medium (sheet). The photosensitive surface of the drum 1 is uniformly charged by means of the charging means 9 and exposed to light reflected from the original 5 by means of the optical system 7. The electric charge on the drum 1 is partially removed by photoconductivity of the surface thereof so that a latent charge image is formed thereon. At the development means 11, toner is attracted to the drum in accordance with the latent image of the electricity. The toner is transferred to a copy medium (sheet) by the transfer means 13 and fused thereto by the fusing means 15 to complete copying operation.

Figure 8:
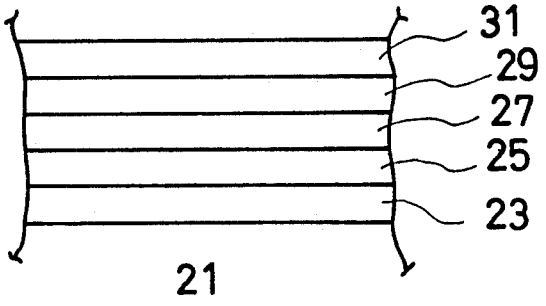
FIG. 8 is a cross sectional view showing an electrophotographic member in accordance with the present invention.

The photosensitive surface of the drum 1, partially illustrated in FIG. 8, is prepared by the following method. An organic photoconductive film is formed on an aluminum cylinder 21 in a triple-layered structure comprising an intermediate layer 23, a charge generating layer 25 and a charge transfer layer (a charge transporting layer) 27. The present invention is characterized by a carbon protective film deposited on the organic photoconductive film. The protective film comprises a buffer layer 29 and an abrasion-proof layer 31.

The buffer layer 29 is deposited by plasma CVD to a thickness of 0.5 μm on the charge transfer layer 27. The reaction pressure is 0.01 Torr. The input power density is 0.06 W/cm$^2$. The negative bias voltage is −50 V. The reactive gas comprises ethylene introduced at 10 SCCM and $NF_3$ introduced at 5 SCCM. The abrasion-proof layer 31 is deposited on the buffer layer 29 also by plasma CVD to a thickness of 1 μm. The reaction pressure is 0.01 Torr. The input power density is 0.06 W/cm$^2$. The negative bias voltage is −100 V. The reactive gas comprises ethylene introduced at 10 SCCM, hydrogen at 90 SCCM and $NF_3$ at 5 SCCM. In accordance with experiments, clear images were constructed in a white background of a paper by the use of the drum prepared by the above procedure. The absorption coefficient was controlled to be no higher than 0.2 $\mu m^{-1}$ with respect to 780 nm wavelength of incident light. The Vickers hardness was controlled between 800 and 2000 kg/mm$^2$. The resistivity was controlled between $10^8$ and $10^{12}$ Ωcm. When the experiment was repeated in the same manner but without the use of $NF_3$, the whole surface of a copy paper greyed when images were transferred. The grey color typically indicated a high residual potential and a high resistivity of the protective film. When the experiment was repeated in the same manner but without the use of $NF_3$ and hydrogen, images faded in white which typically indicated short of exposure and a low transparency of the protective film.

The foregoing description of preferred embodiments has been presented for purposes of illustration and description. It is not intended to be exhaustive or to limit the invention to the precise form described, and obviously many modifications and variations are possible in light of the above teaching. The embodiment was chosen in order to explain most clearly the principles of the invention and its practical application thereby to enable others in the art to utilize most effectively the invention in various embodiments and with various modifications as are suited to the particular use contemplated.

What is claimed is:

1. An electrophotographic machine comprising:

means for charging an electrophotographic member;

means for applying a light image to the charged electrophotographic member to form a latent charge image on the electrophotographic member;

means for applying toner to the latent charge image to form a toner image; and means for transferring the toner image to a medium, wherein said electrophotographic member comprises:

a substrate;

a photosensitive film formed on said substrate; and a protective film formed on said photosensitive film where said protective film comprises a buffer layer of 100 to 400 kg/mm$^2$ Vickers hardness above said photosensitive film and an abrasion-proof layer of 1200 kg/mm$^2$ or higher Vickers hardness above said buffer layer and where each of said buffer layer and said abrasion-proof layer comprises carbon at no lower than 50 atom %, hydrogen at 10 to 40 atom %, and nitrogen at 1 to 10 atom %.

2. The electrophotographic machine as claimed in claim 1 wherein said photosensitive film is made of an organic photoconductive material.

3. The electrophotographic machine as claimed in claim 1 wherein said photosensitive film comprises an intermediate layer, a charge generating layer and a charge transporting layer.

4. The electrophotographic machine as claimed in claim 1 wherein the thickness of said buffer layer is 0.3 to 0.8 $\mu$m.

5. The electrophotographic machine as claimed in claim 1 wherein said substrate is made of aluminum.

6. The electrophotographic machine as claimed in claim 1 wherein said protective film further comprises fluorine at no higher than 1 atom %.

7. An electrophotographic member for electrophotographic machines comprising:

a substrate;

a photosensitive film formed on said substrate; and a protective film formed on said photosensitive film wherein said protective film comprises a buffer layer of 100 to 400 kg/mm$^2$ Vickers hardness above said photosensitive film and an abrasion-proof layer of 1200 kg/mm$^2$ or higher Vickers hardness above said buffer layer and where each of said buffer layer and said abrasion-proof layer comprises carbon at no lower than 50 atom %, hydrogen at 10 to 40 atom %, and nitrogen at 1 to 10 atom %.

8. The member for electrophotographic machines as claimed in claim 7 wherein said protective film further comprises fluorine at no higher than 1 atom %.

9. The member for electrophotographic machines as claimed in claim 7 wherein said photosensitive film is made of an organic photoconductive material.

10. The member of electrophotographic machines as claimed in claim 7 wherein said photosensitive film comprises an intermediate layer, a charge generating layer and a charge transporting layer.

11. The member for electrophotographic machines as claimed in claim 7 wherein the thickness of said buffer layer is 0.3 to 0.8 $\mu$m.

12. The member for electrophotographic machines as claimed in claim 7 wherein said abrasion-proof layer has an absorption coefficient of no higher than 0.2 $\mu m^{-1}$ at 780 nm wavelength, a vickers hardness of 800 to 2000 kg/mm$^2$ and a resistivity of $1\times10^8$ to $1\times10^{12}$ $\Omega$cm.

13. The member for electrophotographic machines as claimed in claim 7 wherein said substrate is made of aluminum.

14. A method of forming an electrophotographic member for electrophotographic machines comprising:

forming a buffer layer of 100 to 400 kg/mm$^2$ Vickers hardness comprising carbon, hydrogen, and nitrogen on a photoconductor film provided on a substrate in a chamber with first gases introduced into said chamber, forming an abrasion-proof layer of 1200 kg/mm$^2$ or higher Vickers hardness comprising carbon, hydrogen, and nitrogen on said buffer layer in said chamber with second gases introduced into said chamber, wherein said first and second gases each comprises carbon, hydrogen, and nitrogen.

15. The method of claim 14 wherein said first and second gases each comprise a carbon containing gas, a hydrogen containing gas, and a nitrogen containing gas.

16. The method of claim 15 wherein said carbon containing gas comprises a gas selected from the group consisting of $CH_4$, $C_2H_5$, $C_3H_8$, $C_2H_4$, $C_2H_2$, and $C_6H_6$

17. The method of claim 15 wherein said nitrogen containing gas comprises $NF_3$.

* * * * *